US005937578A

United States Patent [19]

Dolan et al.

[11] Patent Number: 5,937,578

[45] Date of Patent: Aug. 17, 1999

[54] GARAGE DOOR SAFETY SENSOR MOUNTING ASSEMBLY

[76] Inventors: Thomas M. Dolan, 10085 Davis Rd., Utica, N.Y. 13502; John E. Nelson, P.O. Box 372, Poland, N.Y. 13431

[21] Appl. No.: 08/911,664

[22] Filed: Aug. 15, 1997

[51] Int. Cl.[6] ..... E05F 15/02; E05B 53/00

[52] U.S. Cl. ..... 49/26; 49/25

[58] Field of Search ..... 49/25, 26, 27, 49/28; 403/297, 370; 361/809

[56] References Cited

U.S. PATENT DOCUMENTS

| | | | |
|---|---|---|---|
| 614,944 | 11/1898 | Gaylor | 403/256 |
| 3,561,798 | 2/1971 | Redfern | 403/370 |
| 4,095,908 | 6/1978 | Schofer et al. | 403/370 |
| 5,016,141 | 5/1991 | Lorig et al. | 361/809 |
| 5,040,331 | 8/1991 | Merendino et al. | 49/25 |
| 5,381,308 | 1/1995 | Wolpert et al. | 361/809 |
| 5,428,923 | 7/1995 | Waggamon | 49/28 |
| 5,508,511 | 4/1996 | Zur et al. | 49/26 |
| 5,557,887 | 9/1996 | Feollows et al. | 49/28 |

*Primary Examiner*—Daniel P. Stodola
*Assistant Examiner*—Curtis A. Cohen
*Attorney, Agent, or Firm*—Robert O. Wright

[57] ABSTRACT

A mounting assembly for safety sensors for automatic garage door openers is shown in which the sensor is gimbal mounted in a insect and dust proof shroud on a mounting stud. The stud and shroud are adjustable in height. The shroud has transparent lenses for sensor and status information and provides protection against external impact to the sensor as well as improved safety for users of the device.

8 Claims, 2 Drawing Sheets

GARAGE DOOR SAFETY SENSOR MOUNTING ASSEMBLY

BACKGROUND OF INVENTION

This invention relates to automatic garage door opening apparatus and more particularly to a mounting assembly for the safety sensors mounted on either side of the door opening adjacent the bottom thereof.

Effective Jan. 1, 1993 all electric garage door openers installed must be equipped with a safety device that will reverse a closing door if an obstruction is present in the last six inches of the door's travel. These safety devices have generally taken the form of infrared transmitter and receiving cells being installed on either side of the door opening at the bottom of the opening. The sensors have usually been mounted on a metal bracket that extends from the frame into the garage past the door track so as to give a clear transmission path across the door opening. The sensors have thus been subject to frequent impact with people, vehicles and other objects that knock the units out of alignment and even break them requiring replacement of the entire unit.

In addition the sensors being mounted in the open near the floor are subject to collecting all sorts of dust, dirt, insects and other debris which greatly reduces the sensitivity of the sensors and eventually may cause the door opener not to function necessitating frequent cleaning to ensure reliable operation.

OBJECTS AND SUMMARY OF THE INVENTION

Accordingly it is an object of the present invention to provide an improved mounting system for garage door opener safety sensors.

It is another object of the present invention to provide a mounting assembly for safety sensors for garage door openers which protects the sensors from both contamination and direct physical damage.

It is yet another object of the present invention to provide a mounting assembly for garage door safety sensors that not only protects the sensors but also protects people walking by them from injury by accidental contact therewith.

It is a further object of the present invention to provide a garage door safety sensor mounting assembly that will maintain alignment of the sensors even though the sensor housing is impacted with a substantial but non destructive force.

It is a still further object of the present invention to provide a garage door safety sensor mounting assembly in which the shroud assembly may be used as a gage to position the base member at the federally mandated height position by placing the shroud assembly on the floor and installing fasteners through the base member holes to secure the base member to the wall.

These and other and further objects are achieved in one embodiment in which a base member has an adjustable mounting pedestal for a sensor generally in the center of the base and a protective shroud with optical ports, completely enclosing the sensor and mounting pedestal, fixed to the outer periphery of the base member. The space between the shroud and sensor is chosen to provide omnidirectional clearance about the sensor from impact blows to the shroud short of actual destruction of the assembly. The shroud also effectively seals out dust and insects normally encountered in a garage setting.

DESCRIPTION OF PREFERRED EMBODIMENT

Figure 4:
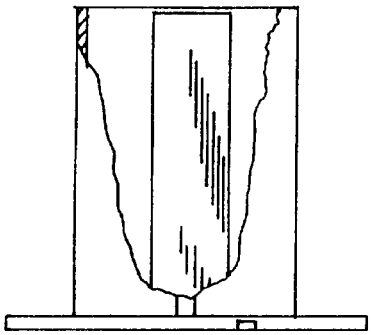
FIG. 4 is an end elevation of the base member partially broken away to show the location of the sensor mounting stud.
Figure 3:
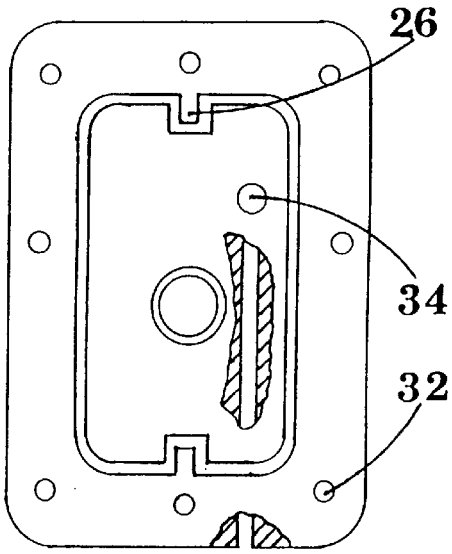
FIG. 3 is a top plan view of the base member of the assembly of FIG. 1.
Figure 1:
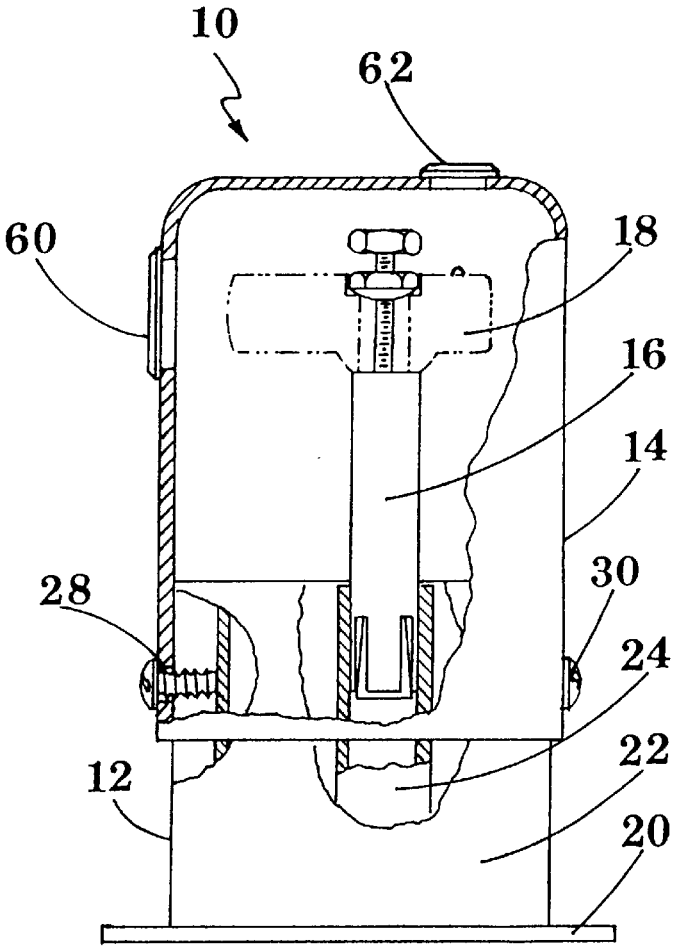
FIG. 1 is a side elevation, partially broken away, of the mounting assembly according to the present invention.
Figure 5:
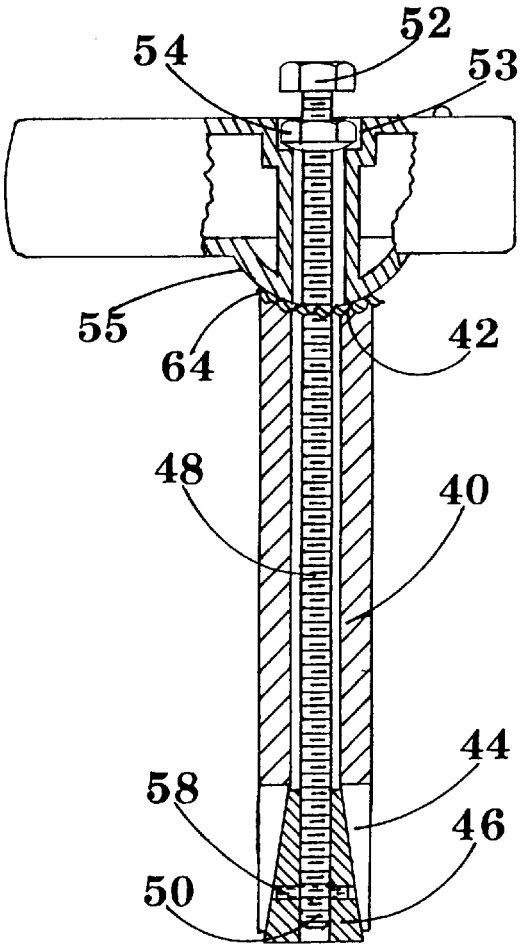
FIG. 5 is a sectional view of the sensor mounting stud showing the gimbal mounting of the sensor.

Referring now to FIG. 1 the safety sensor assembly 10 has a base member 12, an outer shroud 14, a mounting pedestal or stud assembly 16 and a sensor head 18. The base member 12 has a flat base plate portion 20, upon which is formed an outer tubular sleeve 22 and an inner tubular sleeve 24. The sleeves 22 and 24 are mounted perpendicular to the base plate 20 and have a vertical length sufficient to permit the outer shroud 14 to be adjusted up and down (compare positions in FIGS. 1 and 2) to accommodate various sensor 18 heights at time of installation. Typically a sleeve length of about three inches has been found satisfactory. Outer sleeve 22 also has a pair of slots 26 formed in opposite ends as may best be seen in FIGS. 2 and 3. Holes 28 are formed in the ends of shroud 14 adjacent the bottom through which screws 30 are inserted into slots 26. The size of the slots and screws are chosen so that the screws will be self tapping in forming threads in the slots and just long enough to fill the slot and block entrance of insects and other dirt into the inner part of the assembly.

Base plate 20 has a series of holes 32 formed about the periphery to permit easy mounting of the assembly on the usual wall and/or door frame surrounding a garage door opening. A clearance hole 34 may be provided for the usual electrical wires connecting the sensor 18 to the rest of the door control system.

Inner sleeve 24 is positioned at the center of the outer sleeve 22 and forms a receptacle for the mounting stud 16. Stud 16 is a tubular sleeve 40 with a concave upper surface 42, and a partially slit lower end 44. A spherically faced nut 54 is positioned on the upper end of threaded bolt 48 which is inserted through sensor 18 and tubular sleeve 40 into tapered plug 46. Plug 46 is secured to the end 50 of bolt 48 by pin 58. The sensor 18 housing is provided with a recess 53 on the upper side and a convex boss 55 on the lower surface. As bolt 48 is retracted from nut 54 by rotation of head 52 plug 46 is tightened into the slit end 44 of tubular sleeve 40 which expands and secures stud 16 in position in inner sleeve 24 of base 12. Spherically sided hex nut 54 positioned on the upper threaded portion of bolt 48 cooperates with recess 53 in the sensor 18 housing and together with boss 55 and convex surface 42 in stud 16 permits sensor 18 limited gimbal action relative to stud 16 to properly align the sensor on one side of the door opening with the sensor on the other side. A locking washer 64 is provided between surfaces 55 and 42 in the stud assembly 16. Once aligned the sensor and stud are locked in position by retracting bolt 48 to secure the stud 16 assembly in inner sleeve 24 of the base member 12.

The outer shroud 14 has two transparent lenses 60 and 62 positioned in the surface thereof. Lens 60 is positioned in the end of the shroud 14 to permit the sensor 18 to send and receive infrared beams to a companion assembly on the opposite side of a door opening. The lens 62 is provided in the top of shroud 14 to permit observation of the usual LED bulb on the top of the sensor 18 which is used to indicate proper operation of the safety sensors when activated.

Figure 2:
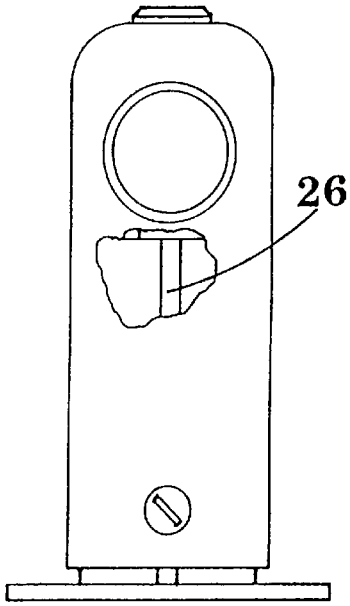
FIG. 2 is an end elevation of the assembly of FIG. 1 showing the shroud in minimum height position.

As may be seen from FIGS. 1 and 2 the shroud 14 may be adjusted vertically relative to base member 12 to accommodate variable sensor height and size requirements while at the same time maintaining a tight seal about the base outer sleeve 22 to keep the sensor free of insects, dirt, and other debris. Shroud 14 is formed with well rounded corners and edges not only to conform to the base inner sleeve but also to help in deflecting accidental impact to the assembly. Also it must be noted the shroud is sized considerably larger than the sensor 18 so that accidental striking of the shroud will normally not hit the sensor so that the proper alignment of the sensors is not disturbed.

Figure 6:
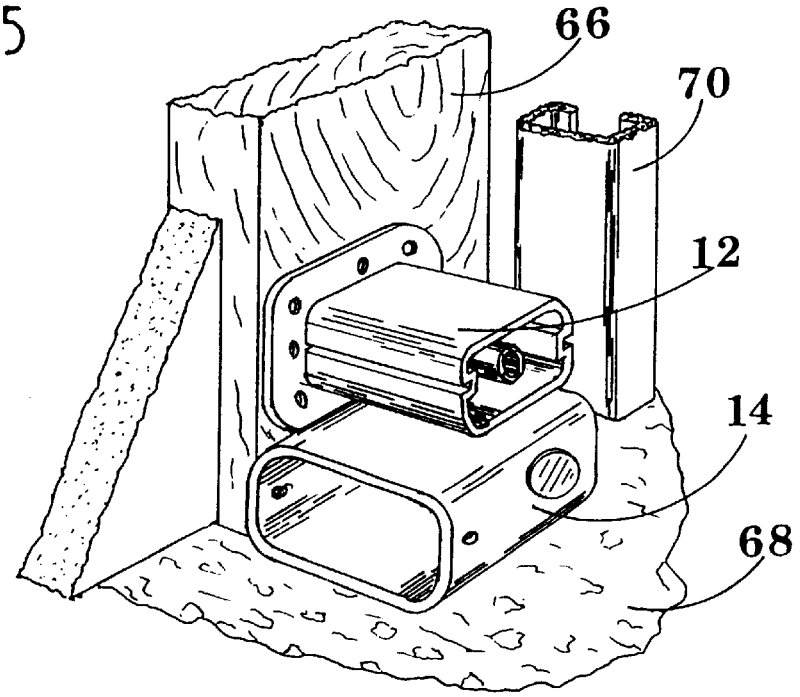
FIG. 6, is a perspective view showing the shroud assembly in use as an height gage.

Referring now to FIG. 6 the outer shroud 14 is shown being used as a gage to position the base member 12 at the required height from the floor 68 when it is mounted on the door frame 66. In a preferred embodiment of the invention the shroud width is chosen so as to provide the federally required spacing of the beam above the floor across the door opening. The juxtaposition of the sensor assembly 10 to the door track 70 is also shown.

While there are given above certain specific examples of this invention and its application in practical use, it should be understood that they are not intended to be exhaustive or to be limiting of the invention. On the contrary, these illustrations and explanations herein are given in order to acquaint others skilled in the art with this invention and the principles thereof and a suitable manner of its application in practical use, so that others skilled in the art may be enabled to modify the invention and to adapt and apply it in numerous forms each as may be best suited to the requirement of a particular use.

We claim:

1. In an automatic garage door opener apparatus having a safety sensor system for preventing door closure when an obstruction is present, a protective sensor mounting assembly comprising:

a base member having a flat plate portion;

an outer generally tubular sleeve member mounted on said plate portion and extending perpendicularly from one side thereof;

an inner generally tubular sleeve member mounted within said outer tubular member on said plate portion and extending perpendicularly from said plate portion;

a sensor mounting stud member having first and second ends;

said stud member first end having a curved surface to pivotally mount a sensor mechanism thereon;

said stud member second end slidably engaging within said inner tubular sleeve to operatively position a sensor mounted on said stud member first end relative to said base member;

an outer shroud member having an open end slidably engaging and completely surrounding said outer tubular member to seal out dirt and debris;

said shroud member extending from said plate a distance to prevent non-destructive external impact to said shroud member from misaligning a sensor mechanism mounted on said stud member first end.

2. The invention as claimed in claim 1 wherein said shroud member size is chosen to telescopically engage about said outer sleeve member and said shroud member is formed with large radius rounded edges and corners to minimize injury and maximize deflection of external impacts.

3. The invention as claimed in claim 1 wherein said shroud is sized to clear a sensor when mounted on said stud member by a distance of at least one inch.

4. The invention as claimed in claim 1 wherein said stud member first end includes gimbal mounting means for rotation and azimuth adjustment of a sensor when mounted thereon.

5. The invention as claimed in claim 1 wherein said stud member comprises a tubular shaft partially split at one end and having a concave surface at the other end;

a threaded screw member positioned within said shaft carrying a tapered plug on the end adjacent the split end of said shaft; and said screw member carrying adjacent the head thereof a spherically sided hex nut to provide a gimbal mounting for a sensor when mounted on said tubular shaft.

6. The invention as claimed in claim 1 further including an optical window means in said shroud member to permit a sensor when mounted therein to transmit and receive infrared signals through said window means.

7. The invention as claimed in claim 6 further including second optical window means to permit monitoring of the operational status when a sensor is mounted within said shroud.

8. The invention as claimed in claim 1 wherein said outer shroud member has at least one outer dimension chosen as a height gage to position said base member, when rested thereon, at an installation height that will cause a sensor mounted on said base member to be within federally mandated height limitations.

* * * * *